United States Patent [19]

Sakamoto et al.

[11] Patent Number: 4,571,163

[45] Date of Patent: Feb. 18, 1986

[54] AXIAL CLEARANCE ADJUSTMENT MECHANISM FOR SCROLL-TYPE FLUID DISPLACEMENT APPARATUS

[75] Inventors: Seiichi Sakamoto; Kiyoshi Terauchi, both of Gunma, Japan

[73] Assignee: Sanden Corporation, Gunma, Japan

[21] Appl. No.: 587,467

[22] Filed: Mar. 8, 1984

[30] Foreign Application Priority Data

Mar. 15, 1983 [JP] Japan ..... 58-36346[U]

[51] Int. Cl.[4] ..... F01C 1/04; F01C 21/10

[52] U.S. Cl. ..... 418/55; 418/57

[58] Field of Search ..... 418/55, 57

[56] References Cited

U.S. PATENT DOCUMENTS 4,178,143 12/1979 Thelen et al. ..... 418/55

4,460,321 7/1984 Terauchi ..... 418/55

FOREIGN PATENT DOCUMENTS 55-64179 5/1980 Japan ..... 418/55

57-148086 9/1982 Japan ..... 418/55

*Primary Examiner*—John J. Vrablik

*Assistant Examiner*—Theodore W. Olds

*Attorney, Agent, or Firm*—Banner, Birch, McKie & Beckett

[57] ABSTRACT

A scroll-type fluid displacement apparatus is disclosed having an adjustment mechanism for adjusting the axial clearance between the spiral elements and end plates of the fixed end orbiting scrolls. The axial position of the fixed scroll within the casing of the apparatus—and, therefore, the axial clearance between scrolls—is adjustable by means of a locating mechanism, such as an adjusting screw threadably engaged with the end plate of the casing and in contact with the end plate of the fixed scroll. The fixed scroll is stabilized within the casing to maintain parallelism of the scroll end plates by mating, relatively axially slidable guide projections on the end plate of the fixed scroll and the end plate of the casing.

7 Claims, 3 Drawing Figures

AXIAL CLEARANCE ADJUSTMENT MECHANISM FOR SCROLL-TYPE FLUID DISPLACEMENT APPARATUS

BACKGROUND OF THE INVENTION

This invention relates to a fluid displacement apparatus and, more particularly, to an axial clearance adjustment mechanism for a scroll-type fluid displacement apparatus.

Scroll-type fluid displacement apparatus are well-known in the prior art. For example, U.S. Pat. No. 801,182 (Cruex) discloses a device including two scroll members each having a circular end plate and a spiroidal or involute spiral element. These scroll members are maintained angularly and radially offset so that both spiral elements interfit to make a plurality of line contacts between their spiral curved surfaces to thereby seal off and define at least one pair of sealed off fluid pockets. The relative orbital motion of the scroll members shifts the line contacts along the spiral curved surfaces and, therefore, the fluid pockets change in volume. Since the volume of the fluid pockets increases or decreases, depending on the direction of the oribital motion, the scroll-type fluid displacement apparatus is applicable to compress, expand or pump fluids.

In comparison with conventional compressors of the piston type, the scroll-type compressor has certain advantages, such as fewer parts and continuous compression of fluid. However, one of the problems encountered in prior art scoll-type compressors is ineffective sealing of the fluid pockets. Axial and radial sealing of the fluid pockets must be maintained in a scroll-type compressor in order to achieve efficient operation. The fluid pockets in a scroll-type compressor are defined by both line contacts between the interfitting spiral elements and the axial contacts between the axial end surfaces of the spiral elements and the inner surfaces of the adjacent end plates. Thus, the clearance between the scroll members, particularly the axial clearance between the axial end surfaces of the spiral elements and the inner surfaces of the end plates of the scroll members, exerts an influence upon the volumetric efficiency or energy efficiency of the scroll-type compressor.

Generally, the fixed scroll member of a prior art scroll-type fluid apparatus is fixedly disposed within the housing. In some cases, axial clearance between the axial end surface of the spiral element of one scroll member and the inner surface of the end plate of the other scroll member is adjusted by placing a plurality of shims between the casing and the end plate of the fixed scroll member. However, since there is a limit to the thickness of the shims, very fine adjustment of axial clearance is difficult to achieve. In the event the axial clearance is too great, the gap between the axial end surface of the spiral element of one scroll member and the inner surface of the end plate of the other scroll member is sealed by a sealing element placed between these surfaces.

Furthermore, in the above prior art scroll-type apparatus, one of the scroll members generally is formed of hard material and the other scroll member is formed of slightly softer material in order to reduce weight. This difference in hardness results in increased wear of the end plate of the softer scroll member due to constant sliding contact by the axial sealing element placed between this end plate and the spiral element of the hard scroll member. Therefore, the inner surface of the end plate of the softer scroll member normally must be provided with a bottom plate for preventing wear of the end plate.

One solution to the above problem is described in commonly assigned, Terauchi U.S. Pat. No. 4,460,321 issued on July 17, 1984. The apparatus disclosed in that patent has an annular opening which is formed through the center portion of the end plate of the cup-shaped casing of the apparatus, the opening having a threaded portion at the inner surface thereof. An adjusting screw is screwed into the threaded portion, the inner end of the adjusting screw fitting against the end surface of the end plate of the fixed scroll member to push it toward the orbiting scroll, thereby setting suitable axial clearance between the scroll members. However, since during assembly of the apparatus the fixed scroll is initially supported within the cup-shaped casing only by contact between the peripheral surface of the end plate and the adjacent inner surface of the cup-shaped casing, if the adjusting screw is moved the fixed scroll member often is skewed relative to the orbiting scroll. Thus, during adjustment of axial clearance, parallelism of the scroll end plates cannot be maintained, and effective axial sealing is lost.

SUMMARY OF THE INVENTION

It is a primary object of this invention to provide an improved scroll-type fluid displacement apparatus in which the axial clearance between the interfitting scroll members can properly be set by an adjustment mechanism to accommodate changes in operating conditions and to minimize wear of the scroll members.

It is another object of this invention to provide a scroll-type fluid displacement apparatus in which the parallelism of the facing end plates of the scroll members is easily maintained during adjustment.

It is still another object of this invention to provide a scroll-type fluid displacement apparatus which accomplishes the above objects while being simple in construction and easy to manufacture.

These and other objects are accomplished by providing, in a scroll-type fluid displacement apparatus of the aforementioned type, means for adjusting and setting the axial clearance between the axial ends of the spiral wraps and the scroll end plates. The adjusting means comprises first axial guide means supported on the interior of the housing and second axial guide means supported on the exterior of the fixed scroll member. The first and second guide means interfit with one another and are relatively axially slidable to permit axial movement of the fixed scroll member relative to the housing while maintaining the scroll end plates parallel. The adjusting means also comprises fixed scroll member positioning means which is accessible from the exterior of the housing to axially move and position the fixed scroll member, and locking means accessible from the exterior of the housing for releasably locking the fixed scroll member in a preselected axial position, thereby setting the axial clearance.

DETAILED DESCRIPTION OF THE PREFERRED EMBODIMENTS

Figure 1:
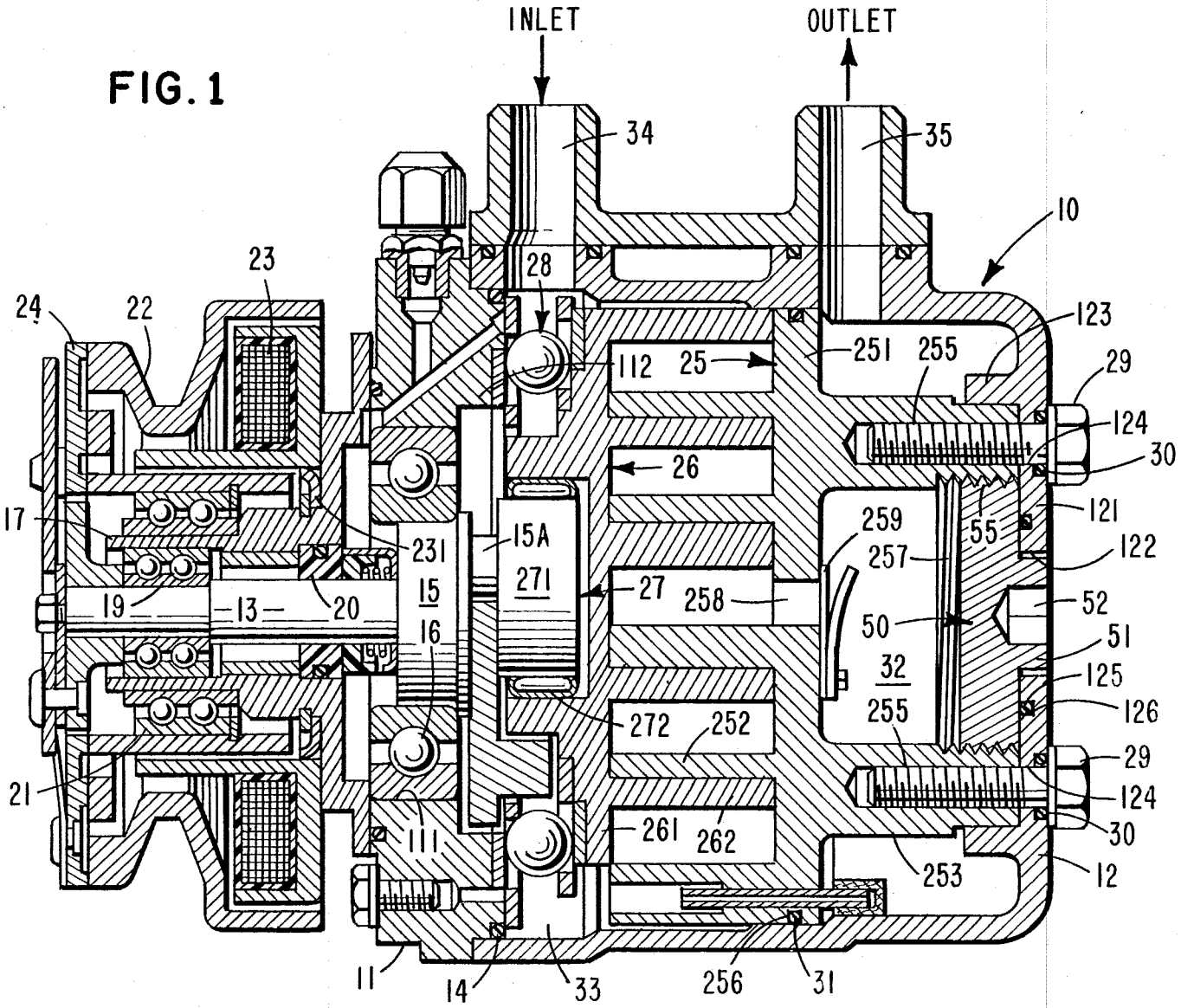
FIG. 1 is a vertical sectional view of a compressor according to one embodiment of this invention.

Referring to FIG. 1, a scroll-type refrigerant compressor in accordance with the present invention is shown. The compressor includes a compressor housing 10 having a front end plate 11 and a cup-shaped casing 12 fastened to an end surface of front end plate 11. An opening 111 is formed in the center of front end plate 11 for supporting drive shaft 13. An annular projection 112, concentric with opening 111, is formed on the rear end surface of front end plate 11 facing cup-shaped casing 12. An outer peripheral surface of annular projection 112 fits into an inner surface of the opening of cup-shaped casing 12. Cup-shaped casing 12 is fixed on the rear end surface of front end plate 11 by a fastening device (not shown), so that the opening of cup-shaped casing 12 is covered by front end plate 11. An O-ring 14 is placed between the outer surface of annular projection 112 and the inner surface of the opening of cup-shaped casing 12 to seal the mating surfaces of front end plate 11 and cup-shaped casing 12.

Front end plate 11 has an annular sleeve 17 projecting from the front end surface thereof; this sleeve 17 surrounds drive shaft 13 to define a shaft seal cavity. Sleeve 17 is attached to the front end surface of front end plate 11 by screws (not shown). Alternatively, sleeve 17 may be formed integral with front end plate 11.

Drive shaft 13 is rotatably supported by sleeve 17 through a bearing 19 disposed within the front end of sleeve 17. Drive shaft 13 has a disk-shaped rotor 15 at its inner end. Disk-shaped rotor 15 is rotatably supported by front end plate 11 through a bearing 16 disposed within opening 111 of front end plate 11. A shaft seal assembly 20 is assembled on drive shaft 13 within the shaft seal cavity of sleeve 17.

A pulley 22 is rotatably supported on the outer surface of sleeve 17 through a bearing 21. An electromagnetic annular coil 23 is mounted on the outer surface of sleeve 17 through support plate 231, which is received in an annular cavity of pulley 22. An armature plate 24 is elastically supported on the outer end of drive shaft 13 which extends from sleeve 17. A magnetic clutch is formed by pulley 22, magnetic coil 23 and armature plate 24. Thus, drive shaft 13 is driven by an external power source, for example, an engine of vehicle, through a rotation transmitting device, such as the above-described magnetic clutch.

A number of elements are located within the inner chamber of cup-shaped casing 12 including a fixed scroll 25, an orbiting scroll 26, a driving mechanism 27 for orbiting scroll 26 and a rotation-preventing/thrust-bearing mechanism 28 for orbiting scroll 26. The inner chamber of cup-shaped casing 12 is formed between the inner wall of cup-shaped casing 12 and the inner surface of front end plate 11.

Fixed scroll 25 includes a circular end plate 251, a wrap or spiral element 252 affixed to and extending from one end surface of circular end plate 251, and an annular wall 253. The annular wall 253 axially projects from the other end surface of circular end plate 251 on the side opposite spiral element 252. Annular wall 253 has a plurality of equally spaced tubular portions 254 in which screw holes 255 are formed. Fixed scroll 25 is fixed to end plate 121 of cup-shaped casing 12 by screws 29, which are shown in FIG. 1. These screws 29 screw into screw holes 255 of tubular portions 254 from the outside of end plate 121. Hence, fixed scroll 25 is fixedly disposed within cup-shaped casing 12.

Circular end plate 251 of fixed scroll 25 partitions the inner chamber of cup-shaped casing 12 into a rear chamber 32 having annular wall 253, and a front chamber 33 in which spiral element 252 of fixed scroll 25 is located. A sealing element 31 is disposed within circumferential groove 256 of circular end plate 251 for sealing the outer peripheral surface of end plate 251 and the inner wall of cup-shaped casing 12. A hole or discharge port 258 is formed through circular end plate 251 at the position near the center of spiral element 252; discharge port 258 connects the fluid pocket at the center of spiral element 252 to rear chamber 32 through a reed valve 259.

Orbiting scroll 26, which is disposed in front chamber 33, includes a circular end plate 261 and a wrap or spiral element 262 affixed to and extending from one end surface of circular end plate 261. The spiral elements 252 and 262 interfit at an angular offset of 180° and a predetermined radial offset. The spiral elements define at least a pair of fluid pockets between their interfitting surfaces. Orbiting scroll 26 is connected to the driving mechanism 27 and the rotation-preventing/thrust-bearing mechanism 28. These two mechanisms effect orbital motion of orbiting scroll 26 by rotation of drive shaft 13 to thereby compress fluid passing through the compressor.

The driving mechanism 27 for orbiting scroll 26 includes drive shaft 13 and disk-shaped rotor 15. A crank pin 15A eccentrically projects from an axial end surface of disk-shaped rotor 15. Orbiting scroll 26 is rotatably supported on a bushing 271 which fits into a boss 263 axially projecting from the other end surface of end plate 261 of fixed scroll 26 through a bearing 272. Bushing 271 is rotatably supported on the crank pin. Thus orbiting scroll 26 is rotatably supported on the crank pin of drive shaft 13. Therefore, bushing 271 is driven by revolution of the drive shaft 13. Furthermore, the rotation of orbiting scroll 26 is prevented by rotation-preventing/thrust-bearing mechanism 28 which is placed between the inner wall of the housing and circular end plate 261 of orbiting scroll 26. As a result, the orbiting scroll 26 orbits while maintaining its angular orientation relative to fixed scroll 25. A more detailed description of the type of driving and rotation-preventing/thust-bearing mechanisms used here can be found in U.S. Pat. No. 4,441,604, which is incorporated herein by reference.

As the orbiting scroll 26 orbits, the line contacts between spiral elements 252 and 262 shift toward the center of the spiral elements along the surfaces of the spiral elements. The fluid pockets defined by the line contacts between spiral elements 252 and 262 move toward the center with a consequent reduction of volume to thereby compress the fluid in the fluid pockets. Therefore, fluid or refrigerant gas introduced into front chamber 33 from an external fluid circuit through an inlet port 34 mounted on the outside of cup-shaped casing 12 is taken into the fluid pockets formed at the outer portion of spiral elements 252 and 262. As orbiting scroll 26 orbits, the fluid in the fluid pockets is compressed as the pockets move toward the center of the spiral elements. Finally, the compressed fluid is discharged into rear chamber 32 through hole 258 and valve 259, and there-from, the fluid is discharged to the external fluid circuit through outlet port 35 formed in cup-shaped casing 12.

In the above-described construction, holes 124, each of which is aligned with a respective screw hole 255 of annular wall 253, are formed through end plate 121 of cup-shaped casing 12 for receiving screws 29, and a central opening 122 is formed through the end plate 121 of cup-shaped casing 12. An annular projection 123 projects axially inwardly from the inner surface of end plate 121, and surrounds the opening 122 and holes 124. The outer peripheral surface of annular wall 253 fits into the inner peripheral surface of annular projection 123, and threads 256 are formed on the distal portion of the inner peripheral surface of annular wall 253.

An adjusting screw 50 is screwed into the threaded portion 256 of annular wall 253. Adjusting screw 50 has threads 55 on its outer peripheral surface and a keyed boss 51 projecting axially outward from one end surface thereof through opening 122, with a slight clearance therebetween. Boss 51 has a keyed or driving indentation 52 at its outer end surface for receiving a screwing tool. An O-ring 125 is placed in a circular groove 126 formed on the inner surface of end plate 121 to seal the axial end surface of adjusting screw 50 and the inner surface of end plate 121. Therefore, fluid leakage along the outer surface of adjusting screw 50 is prevented. Furthermore, fluid leakage along holes 124 in cup-shaped casing 12 is prevented by an O-ring 30 placed between the outer end surface of end plate 121 and each screw 29.

The axial clearance between orbiting scroll 26 and fixed scroll 25 can be adjusted as described below.

The driving mechanism 27, rotation-preventing/-thrust-bearing mechanism 28 and orbiting scroll 26 are assembled on front end plate 11. Adjusting screw 50 is then screwed into the threaded portion of wall 253. Fixed scroll 25 is then disposed in and loosely fixed on cup-shaped casing 12 by screws 29 at an angular offset of 180° relative to orbiting scroll 26, so that screw holes 255 of wall 253 are aligned with penetration holes 124 of end plate 121. After cup-shaped casing 12 is fixed on the rear end surface of front end plate 11, adjusting screw 50 is advanced further into the threaded portion of annular wall 253 and is tightened to a desired torque so that the fixed and orbiting scrolls make axial contact. Next, adjusting screw 50 is turned back a desired turn-back angle ($\alpha$) for obtaining proper axial clearance between the fixed and orbiting scrolls to avoid excessive friction betwene the scrolls. After adjusting the axial clearance, screws 29 are tightened to tightly fix the fixed scroll 25 to end plate 121.

The value of axial clearance C is given by $C=t\cdot\alpha/360$, where t is screw pitch and $\alpha$ is the turn-back angle of adjusting screw 50. therefore, the desired axial clearance can be easily obtained by the proper adjustment of turn-back angle $\alpha$ of adjusting screw 50.

In accordance with the above construction, an accurate desired axial clearance betwen the axial end surfaces of both spiral elements and the adjacent end plates can be obtained to thereby improve the sealing efficiency of the sealed off fluid pockets defined by the fixed and orbiting scrolls. This can be accomplished without the use of a tip seal element disposed between the axial end surfaces of the spiral elements and the circular end plates of the scrolls. The axial clearance adjusting mechanism of the present invention can be used to improve the volumetric efficiency and energy efficiency of the scroll-type compressor. Furthermore, excessive friction between the axial end surfaces of the spiral elements and the circular end plates of the scrolls is avoided to minimize wear. With axial clearance precisely set and the resulting ommission of tip seals, the bottom anti-wear plate normally employed to prevent wear of the circular end plate can be omitted as well. Moreover, axial adjustment of the fixed scroll is guided by the inner surface of the cup-shaped casing and the inner peripheral surface of the annular projection 123 on the end plate 121, both of which are parallel with the axis of the fixed scroll. Therefore, the fixed scroll can be axially moved while maintaining end plate parallelism with the orbiting scroll.

Figure 2:
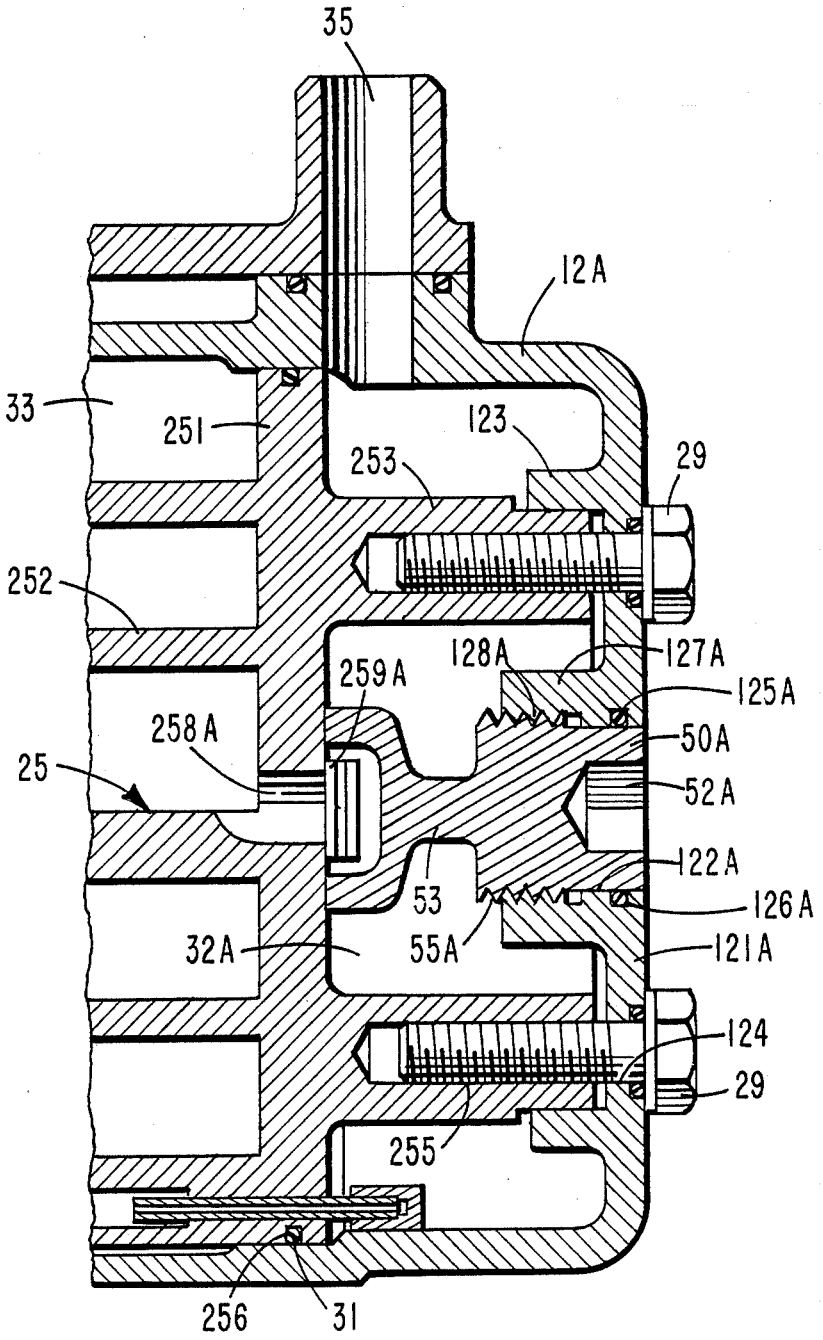
FIG. 2 is a vertical sectional view of a main portion of an adjusting mechanism according to another embodiment of this invention.

Referring to FIG. 2, another embodiment of the invention is shown, illustrating a modification of the construction for the adjusting mechanism, wherein many parts of the mechanim are similar to the parts of the apparatus shown in FIG. 1. In this embodiment, end plate 121A has a second annular projection 127A projecting axially inward along the inner surface of opening 122A, and threads 128A are formed on the inner peripheral surface of second annular projection 127A and a part of opening 122A. Adjusting screw 50A (having threads 55A) is screwed into threaded portion 128 of second annular projection 127. Adjusting screw 50A has an extended portion 53 at its inner end surface. An axial end surface of extended portion 53 fits against the end surface of end plate 251. Therefore, axial clearance between the scrolls is adjusted by turning adjusting screw 50A, acting through the extended portion. Adjustment of the axial clearance can be easily done, in the manner mentioned above.

Figure 3:
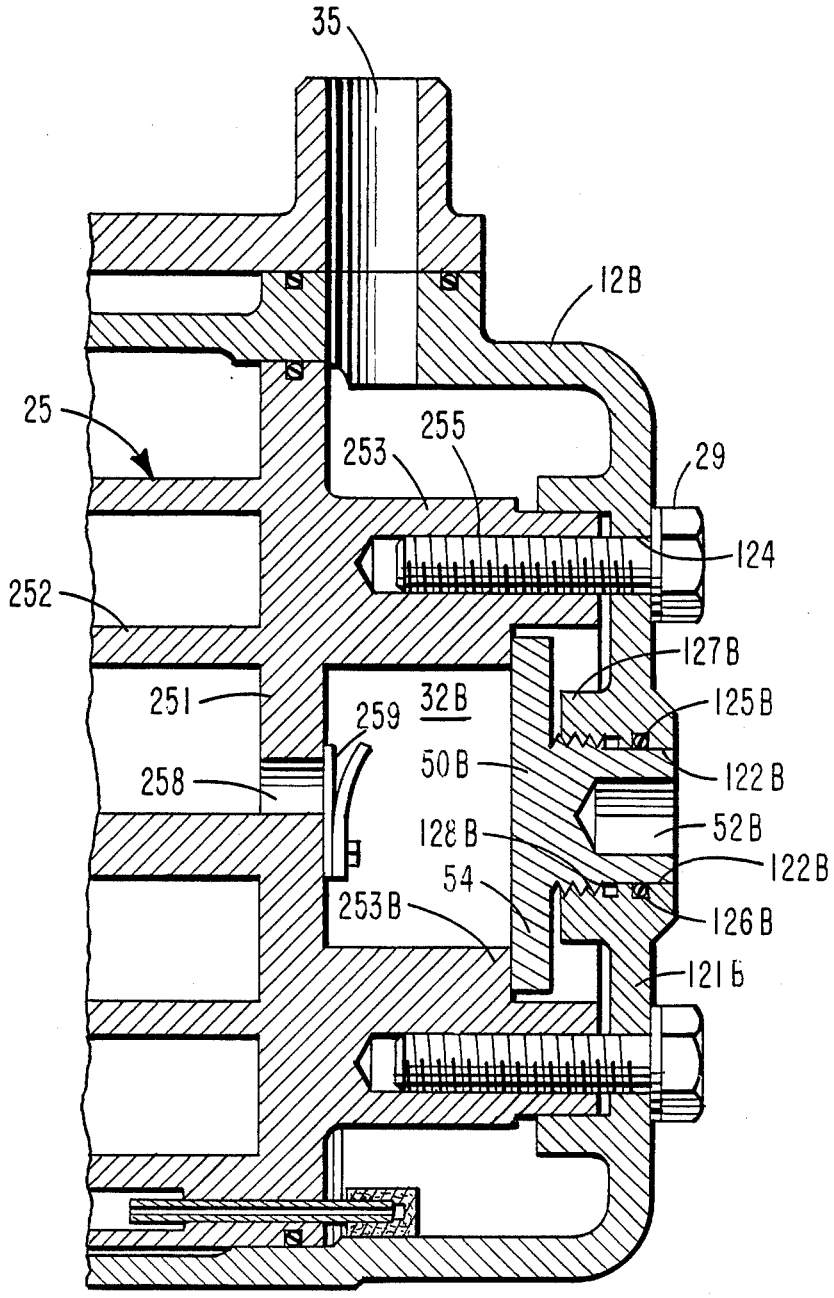
FIG. 3 is a vertical sectional view of a main portion of an adjusting mechanism according to still another embodiment of this invention.

Referring to FIG. 3, still another embodiment of the invention is shown, illustrating a further modification of construciton for the axial clearance adjusting mechanism. In this embodiment, adjusting screw 50B is screwed into the threaded portion 128B of second annular projection 127B and opening 122B, and has a flange portion 54 projecting radially outward. Annular wall 253 of fixed scroll 25 has an inwardly projecting shoulder 253B. The axial end surface of shoulder 253B abuts the axial end of flange 54 of adjusting screw 50. Therefore, axial clearance between the scrolls can be adjusted by movement of the adjusting screw, acting through flange 54 and shoulder 253B.

This invention has been described in detail in connection with preferred embodiments, but these embodiments are merely for example only and this invention is not restricted thereto. It will be easily understood by those skilled in the art that other variations and modifications can be easily made within the scope of this invention, as defined by the appended claims.

We claim:

1. In a scroll-type fluid displacement apparatus including a housing, a fixed scroll fixedly disposed relative to said housing and having a first end plate from which a first wrap extends into the interior of said housing, an orbiting scroll having a second end plate from which a second wrap extends, said first and second wraps interfitting at an angular and radial offset to make a plurality of line contacts to define at least a pair of sealed off fluid pockets, driving and rotation preventing means operatively connected to said orbiting scroll to effect orbital motion of said orbiting scroll while preventing rotation thereof to thereby change the volume of the fluid pockets, and means for adjusting and setting the axial clearance between the axial ends of said wraps and said scroll end plates, the improvement wherein the clearance adjusting means comprises:

first axial guide means supported on the interior of said housing and projecting axially from said housing;

second axial guide means supported on the exterior of said fixed scroll member and projecting axially from said fixed scroll member, said first and second guide means interfitting with one another and being relatively axially slidable to permit axial movement of said fixed scroll member relative to said housing while maintaining the end plates of said scroll members parallel;

fixed scroll member positioning means operatively coupled to said fixed scroll member and accessible from the exterior of said housing to axially move and position from fixed scroll member relative to said housing; and locking means accessible from the exterior of said housing for releasably locking said fixed scroll member in a preselected axial position, thereby setting said axial clearance.

2. A scroll-type fluid displacement apparatus according to claim 1 wherein said first axial guide means comprises an axial projection on the inner surface of the end plate of the housing adjacent said fixed scroll member, and second axial guide means comprises a mating axial projection on the outer surface of the end plate of said fixed scroll member, and said positioning means comprises a rotatable, threaded adjustment screw.

3. A scroll-type fluid displacement apparatus according to claim 2 wherein said first axial guide means comprises an annular axial housing projection, and said second axial guide means comprises an annular axial scroll projection slidable within said housing projection.

4. A scroll-type fluid displacement apparatus according to claim 3 wherein said locking means comprises a plurality of screws extending through holes in said housing end plate and threadably engaged in threaded holes in said annular axial scroll projection.

5. A scroll-type fluid displacement apparatus according to claim 3 wherein said annular axial scroll projection is internally threaded at the distal end thereof, and said adjustment screw is threadably engaged with said scroll projection and has an axial end surface which engages the inner surface of said housing end plate.

6. A scroll-type fluid displacement apparatus according to claim 5 wherein said axial end surface of said adjustment screw is annular, said adjustment screw having a keyed central axial boss at the center of said annular axial end surface which protrudes through a central hole in said housing end plate.

7. A scroll-type fluid displacement apparatus according to claim 2 wherein said housing end plate has a central threaded opening, and said adjustment screw is threadably engaged with said threaded opening and in contact with the axial end surface of said fixed scroll member.

* * * * *

UNITED STATES PATENT AND TRADEMARK OFFICE

CERTIFICATE OF CORRECTION

PATENT NO. : 4,571,163

DATED : February 18, 1986

INVENTOR(S) : Seiichi Sakamoto and Kiyoshi Terauchi

It is certified that error appears in the above-identified patent and that said Letters Patent is hereby corrected as shown below:

Column 6, line 43, "50" should be —50B—.

Signed and Sealed this

*Thirteenth* Day of *May 1986*

[SEAL]

*Attest:*

DONALD J. QUIGG

*Attesting Officer*

*Commissioner of Patents and Trademarks*